US007458842B1

(12) United States Patent
Gange

(10) Patent No.: US 7,458,842 B1
(45) Date of Patent: Dec. 2, 2008

(54) CONNECTOR EJECTOR LEVER WITH A LIGHT PIPE AND METHOD OF MANUFACTURE

(75) Inventor: Charles C. Gange, Rhinebeck, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/772,535

(22) Filed: Jul. 2, 2007

(51) Int. Cl.
*H01R 3/00* (2006.01)

(52) U.S. Cl. ..... 439/490; 439/160; 439/910

(58) Field of Classification Search ..... 439/157, 439/159, 160, 372, 489, 490, 910
See application file for complete search history.

(56) References Cited

U.S. PATENT DOCUMENTS 6,452,790 B1 9/2002 Chu et al.
6,623,292 B1 * 9/2003 Holler et al. ..... 439/490
6,887,095 B2 * 5/2005 Simon et al. ..... 439/488
7,028,213 B2 4/2006 Majni et al.
2002/0160653 A1 * 10/2002 Hu ..... 439/490
2006/0085671 A1 4/2006 Majni et al.
2006/0168422 A1 7/2006 Rippens et al.

* cited by examiner

*Primary Examiner*—Hae Moon Hyeon
(74) *Attorney, Agent, or Firm*—Cantor Colburn LLP; Lily Neff

(57) ABSTRACT

An electrical connector includes a connector body having a first end and an opposite second end. The connector body is configured to receive and electrically connect with an electric module. An ejector lever is pivotally mounted to at least one of the first and second ends for releasable retention of the module. The ejector lever is configured with an aperture therethrough and a light pipe extends through the aperture for alignment with a fault indicator.

6 Claims, 3 Drawing Sheets

CONNECTOR EJECTOR LEVER WITH A LIGHT PIPE AND METHOD OF MANUFACTURE

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates to a method and apparatus to facilitate viewing of a visual indicator obstructed by a surface-mount technology (SMT) connector, and particularly to a method and apparatus to facilitate viewing of a lamp obstructed by a SMT DIMM socket or other SMT connectors.

2. Description of Background

In computer systems such as personal computers, a socket is referred to as an electrical connector generally mounted on a motherboard (main board) in order to connect extension boards such as extended interface boards for peripheral devices or extended memory boards to the motherboard. The motherboard and extension boards may be electrically connected by plugging the extension boards into the electrical connector.

The structure of a common electrical connector will be described here with the example of an electrical connector, as illustrated in FIGS. 1 and 2, used to connect an extension memory module (hereinafter, "module") referred to as a DIMM (dual in-line memory module). This module (not shown) corresponds to the extension board described above.

A dual in-line memory module (DIMM) is becoming more popular for use in the present PC industry, and thus uses a DIMM socket connector mounted on the motherboard for mechanical and electrical interconnect of the corresponding DIMM therein for signal transmission between the motherboard and the DIMM. A main feature of the typical DIMM connector as illustrated in FIGS. 1 and 2 is that the DIMM connector 10 includes generally a pair of ejector levers 12 at two opposite ends of a DIMM connector body 14 so that such DIMM may not only be properly retained in the DIMM connector body 14 without possibility of inadvertent withdrawal by vibration or external impact, but also easily ejected from the DIMM connector body 14 by rotational movement of the ejector lever 12.

Previous designs of the DIMM connector 10 were mechanically anchored to the PCB via the pin-through-hole or compliant pin nature of the PCB leads. With more of the industry moving to SMT (Surface Mount Technology) connectors due to PCB wiring density, path length, and electrical signal integrity concerns, new mechanical requirements emerge due to the delicate SMT interface, compared to the more mechanically robust compliant pin and pin-through-hole interfaces in previous applications. This disclosure addresses the present surface-mount design, which uses solder at the SMT joints and printed wiring board (PWB) solder pads.

The European Union has a directive referred to as RoHS (Reduction of Hazardous Substance), which mandates elimination of the use of lead in the solder for the present surface-mount design. However, the use of lead-free solder raises the processing temperature at which components are subjected to due to the higher melting point temperature of the lead-free solder. The higher melting point temperature can deform or even melt the plastic used to make the current DIMM ejector levers.

For example, certain DIMM socket connectors use clear plastic ejector levers. The clear plastic ejector levers function as light pipes, allowing service personnel to visually inspect activation of amber colored LEDs, which are often obstructed from plain view by an opaque ejector lever, as the LEDs are placed under or near the end of a DIMM socket connector. More specifically, many servers use fault LEDs next to DIMM socket connectors to visually indicate when there is a memory failure of a respective DIMM. However, the clear plastic used in these ejector levers does not stand up well to the increased RoHS soldering temperatures.

One solution to this problem includes assembling the clear plastic levers to the DIMM socket connector once the higher temperature soldering is completed. However, this solution requires significant reworking of manufacturing procedures to hand assemble the ejector levers onto the socket connectors. Furthermore, the tight clearances between adjacent socket connectors mounted to the PCB would make this operation difficult. Therefore, a different solution is still desired.

SUMMARY OF THE INVENTION

The shortcomings of the prior art are overcome and additional advantages are provided through the provision of an electrical connector in accordance with an exemplary embodiment. The electrical connector includes a connector body having a first end and an opposite second end. The connector body is configured to receive and electrically connect with an electric module. An ejector lever is pivotally mounted to at least one of the first and second ends for releasable retention of the module. The ejector lever is configured with an aperture therethrough and a light pipe extends through the aperture for alignment with a fault indicator.

In another exemplary embodiment, a system is disclosed. The system includes a motherboard; a plurality of electrical connectors surface mounted to the motherboard, each electrical connector including a connector body having a first end and an opposite second end, the connector body configured to receive and electrically connect with an electric module; an ejector lever pivotally mounted to at least one of the first and second ends of each connector body for releasable retention of a respective module, the ejector lever configured with an aperture therethrough; and a light pipe extendable through the aperture for alignment with a fault indicator associated with each electrical connector connected to the motherboard.

In yet another exemplary embodiment, a method of manufacturing an ejector lever for a surface mounted electrical connector is provided. The method includes configuring an ejector lever with an aperture therethrough; pivotally mounting the ejector lever to each of a plurality of electrical connectors, each electrical connector including a connector body configured to receive and electrically connect with an electric module, the ejector lever is pivotally mounted to at least one of first and second ends of each connector body of each electrical connector of the plurality of electrical connectors for releasable retention of a respective electric module; and surface mounting the plurality of electrical connectors to a motherboard; and extending a light pipe through the aperture in the ejector lever for alignment with a fault indicator associated with each electrical connector connected to the motherboard.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the exemplary embodiments of the present invention, together with advantages, aspects and features, by way of example with reference to the drawings.

DETAILED DESCRIPTION OF THE INVENTION

The disclosure proposes making the plastic ejector levers out of a same high-temperature plastic used in the rest of the socket. A channel is formed in each ejector lever to allow the addition of a light pipe configured to fit into the ejector lever. After the socket is mounted to the motherboard using a high-temperature soldering process, the light pipe is inserted into the ejector lever. In this manner, the functionality of having an ejector lever which allows service personnel to detect any fault LEDs which may be activated is preserved and the problem associated with high-temperature soldering is eliminated.

Figure 1:
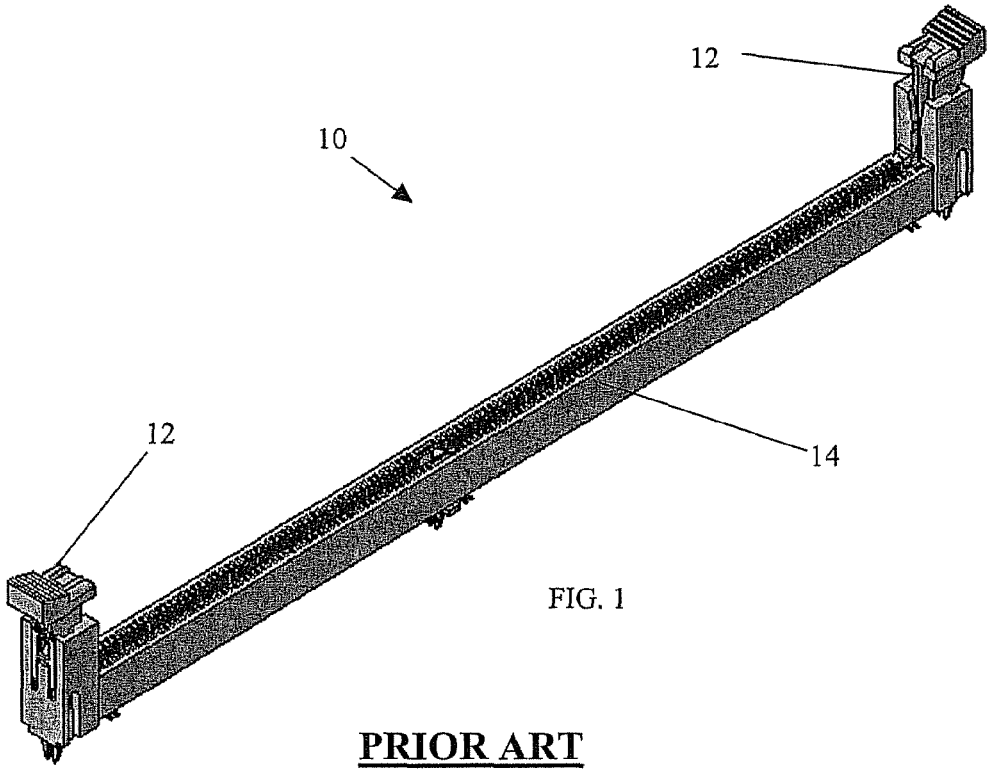
FIG. 1 PRIOR ART
FIG. 1 illustrates a perspective view of a conventional DIMM socket connector.
Figure 2:
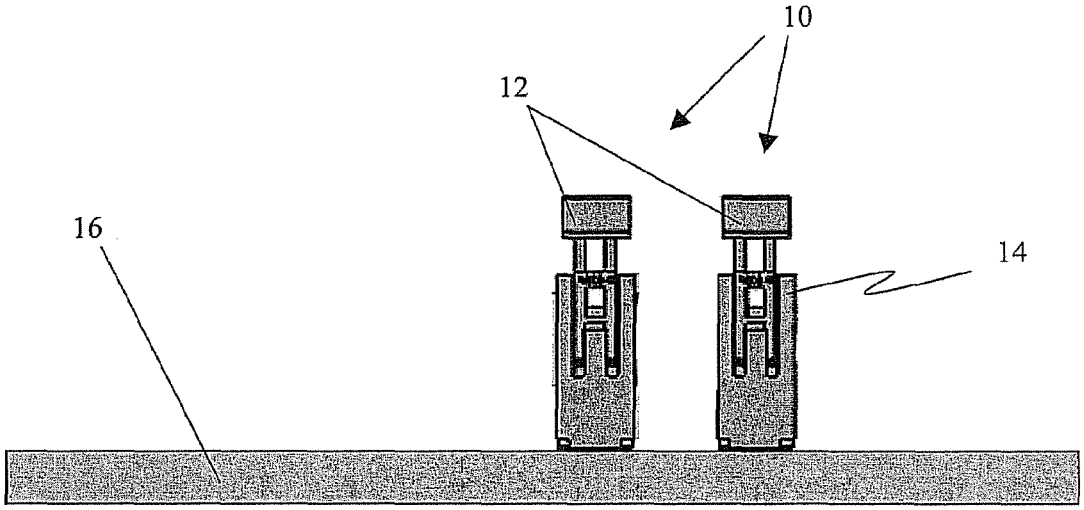
FIG. 2 PRIOR ART
FIG. 2 illustrates a partial elevation end view of two conventional DIMM socket connectors surface mounted to a PCB.
Figure 3:
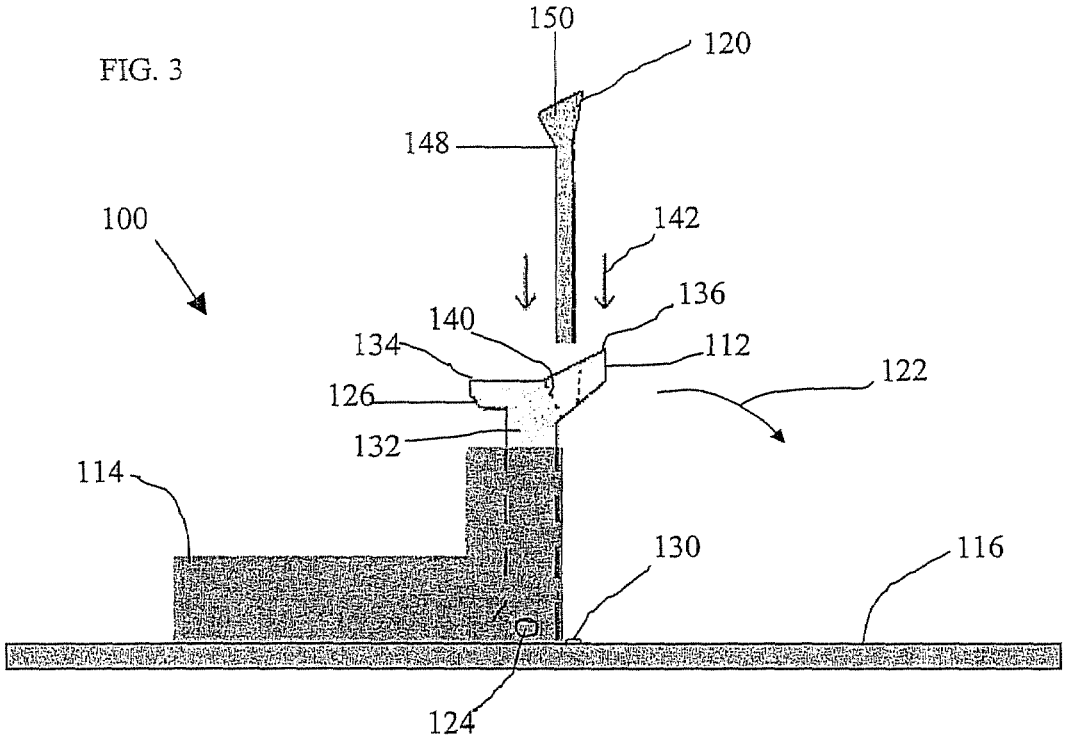
FIG. 3 is an exploded partial elevation side view of one end of a DIMM socket connector illustrating an ejector lever thereof having a removable light pipe in accordance with an exemplary embodiment of the present invention.
Figure 4:
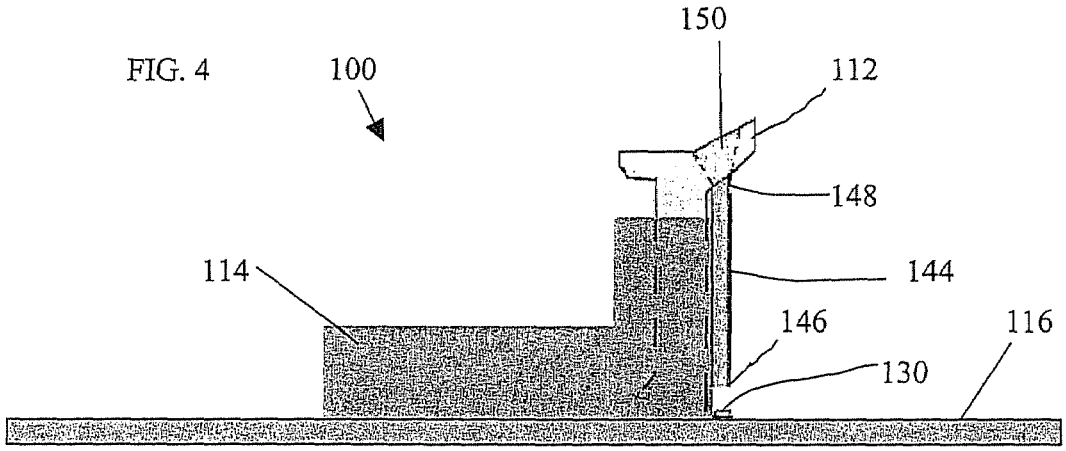
FIG. 4 is a partial elevation side view of the DIMM socket connector of FIG. 3 illustrating the light pipe installed with the ejector lever.

Turning now to the drawings in greater detail, it will be seen that in FIG. 3 there is an exploded partial elevation side view of one end of a DIMM socket connector 100 mounted to a motherboard or PCB 116 illustrating an ejector lever 112 thereof having a removable light pipe 120 in accordance with an exemplary embodiment of the present invention. FIG. 4 is a partial elevation side view of the DIMM socket connector of FIG. 3 illustrating the light pipe installed with the ejector lever.

More specifically, FIG. 3 illustrates the DIMM socket connector 100 including an ejector lever 112 disposed at each terminal end of a DIMM connector body 114 (only one ejector lever 112 shown in FIG. 3). The ejector lever 112 is pivotally attached to the connector body 114 at one pivot end 124 allowing pivotal rotation of the ejector lever 112 as indicated by arrow 122 about the pivot end 124 when an opposite end 126 of the ejector lever 112 is manually moved in the direction of arrow 122.

The connector body 114 is electrically and mechanically mounted to the motherboard 116 using a lead-free solder (not shown). A light emitting diode (LED) fault indicator 130 is also mounted to the motherboard 116 in close proximity to the end of connector body 114 and ejector lever 112. In exemplary embodiments, an LED fault indicator 130 is disposed in close proximity to each respective DIMM socket connector 100 and is activated (e.g., turned on) when a fault is detected with respect to a DIMM connected to the respective DIMM socket connector 100, as is well known to those of ordinary skill in the pertinent art. However, the fault indicator 130 is often obstructed from view by the opposite end 126 of the ejector lever 112 unless the ejector lever is configured of a clear plastic. Therefore, since the ejector lever 112 is configured of an opaque or non-transparent plastic suitable for the higher temperatures associated with using lead-free solder in exemplary embodiments of the present invention, the opposite end 126 of the ejector lever 112 is configured to receive the light pipe 120 to visually inspect the LED fault indicator 130 normally obstructed from view by the opposite end 126 of the ejector lever 112.

Still referring to FIG. 3, an exemplary embodiment of the ejector lever 112 includes a main body 132 extending from the one pivot end 124 and extends to the opposite end 126. The opposite end 126 and main body 132 of the ejector lever 112 define substantially a T-shape. The main body 132 defines a vertical portion of the "T" while the opposite end 126 defines substantially a horizontal or top portion of the "T". The opposite end 126 is further defined having one end as a retaining portion 134 and a remaining portion as a handle portion 136.

The retaining portion 134 of the ejector lever 112 is configured to retain a DIMM (not shown) with the connector body 114 when engaged therewith. The handle portion 136 extends in an opposite direction from the retaining portion 134 and is configured for grasping by a thumb, for example, in order to pivotally move the ejector lever 112 in the direction of arrow 122 or in an opposite direction thereto.

Referring now to FIGS. 3 and 4, the handle portion 136 of the ejector lever 112 is configured with an aperture 140 therethrough. The aperture 140 is configured to receive the light pipe 120 therethrough in a direction indicated by arrows 142 for alignment with the fault indicator 130. The light pipe 120 includes a main body 144 defined by a first end 146 aligned with and proximate the fault indicator 130 and extends to a second end 148. The light pipe 120 further includes a head 150 disposed at the second end 148. The head 150 is configured having a first larger diameter than a second diameter of the main body 144. In this manner, the second diameter of the main body 144 may be slidably extended through the aperture 140 while the first diameter of the head 150 cannot pass therethrough, as best illustrated in FIG. 4. In the exemplary embodiment depicted in FIGS. 3 and 4, the aperture 140 and head 150 are complementarily configured having a tapered shape, however, any other suitable shape for the desired end purpose is contemplated, including a stepped shape, for example, but is not limited thereto. In either case, ejector lever 112 is formed in such a way that it can accept a separate light pipe 120 after completion of soldering the connector body 114 to the motherboard 116 using a lead-free solder.

A plastic which can withstand the higher soldering temperatures associated with lead-free soldering may be used to create the DIMM ejector lever 112. Likewise, existing materials may be used to create the light pipes 120, thereby eliminating the need to create any new composite materials.

Figure 5:
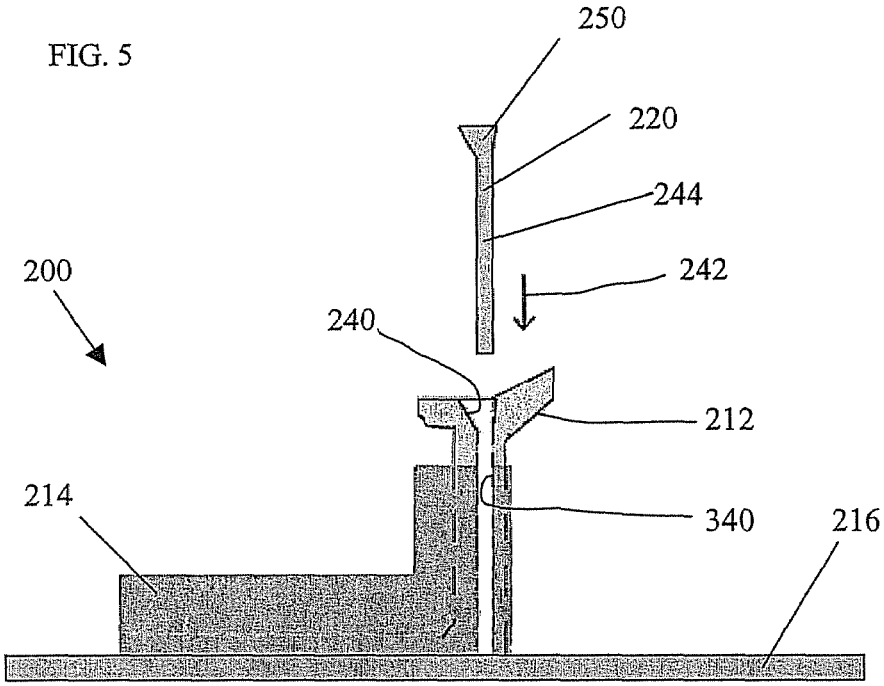
FIG. 5 is an exploded partial elevation side view of one end of a DIMM socket connector illustrating an ejector lever thereof having a removable light pipe in accordance with an alternative exemplary embodiment of the present invention.
Figure 6:
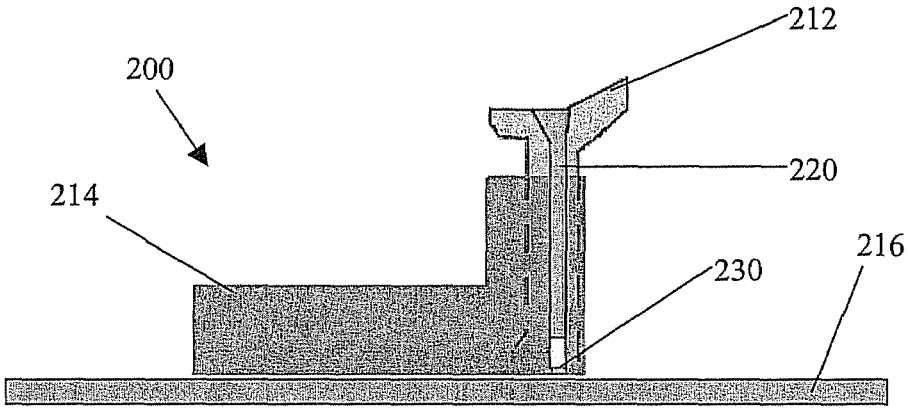
FIG. 6 is partial elevation side view of the DIMM socket connector of FIG. 5 illustrating the light pipe installed with the ejector lever.

FIG. 5 is an exploded partial elevation side view of one end of a DIMM socket connector 200 illustrating an ejector lever 212 thereof having a removable light pipe 220 in accordance with an alternative exemplary embodiment of the present invention. FIG. 6 is a partial elevation side view of the DIMM socket connector 200 of FIG. 5 illustrating the light pipe 220 installed with the ejector lever 212. More specifically, both FIGS. 5 and 6 illustrate an alternative position of the light pipe 220 when an LED fault indicator 230 is positioned under an edge of a connector body of the DIMM socket connector 200 on a board 216.

In this exemplary embodiment, a conical aperture 240 is disposed in a middle portion of an opposite end 126 of the ejector lever 220 and aligned with the fault indicator 230. A smaller diameter aperture 340 extends from aperture 240 to the board 216 in order to receive a main body 244 of the light pipe 220 within the ejector lever 212. Then the light pipe 220 having a head 250 being shaped complementary to the conical aperture 240 may me retained with the ejection lever 212 when the light pipe 220 is slidably disposed through the aperture 240 in the direction indicated by arrow 242 in FIG. 5. As illustrated in FIG. 6, the LED fault indicator 230 can then be seen above the head 250 of the light pipe 220 even though the fault indicator is disposed beneath the connector body 214 corresponding to attachment with the ejection lever 212.

Referring now to FIGS. 3 and 4, a method of manufacturing an ejector lever for a surface mounted electrical connector will be described. The method includes configuring the ejector lever 112 with the aperture 140 therethrough. The ejector lever 112 is pivotally mounted to each of the plurality of electrical connectors 100. Each electrical connector 100 includes a connector body 114 configured to receive and electrically connect with the electric module (e.g., DIMM not shown)). The ejector lever 112 is pivotally mounted to at least one of first and second ends of each connector body 114 of each electrical connector 100 for releasable retention of a respective electric module (not shown). Each electrical connector 100 is surface mounted to the motherboard 116 using solder. In exemplary embodiments, lead-free solder is used to surface mount each electrical connector 100 to the motherboard 116. After the electrical connectors 100 are surface mounted to the motherboard 116 using the high temperature soldering process associated with using lead-free solder, the light pipe 120 is slidably extended through the aperture 140 disposed in the ejector lever 112 for alignment with the fault indicator 130 associated with each corresponding electrical connector 100 connected to the motherboard 116. In exemplary embodiments, the fault indicator 130 is a light emitting diode.

It will be recognized by those skilled in the pertinent art that the aperture 140 may be configured as a conical or stepped shape aperture to retain one end of the light pipe 120 therewith. It will also be recognized that although the aperture 140 extends only through the handle portion 136 of the ejector lever 112, the aperture may extend through the main body 132 of the ejector lever 112 in alternative exemplary embodiments, as depicted in FIGS. 5 and 6. Furthermore, it will be noted that the aperture 140 may be formed in the ejector lever 112 either before or after pivotally mounting the ejector lever 112 the respective electrical connectors 100. Likewise, the aperture 140 may be formed either before or after surface mounting the electrical connectors 100 to the motherboard 116.

By forming a conical or stepped hole through a middle portion of the ejector lever 112, e.g., the "ear" of the ejector lever 112, a separate light pipe 120 may be added to the lever 112 whenever needed. Since only one lever 112 on each DIMM socket 100 would require a light pipe 120, the impact to manufacturing procedures is less than other solutions. In addition, the operation of inserting the light pipe through the ejector lever is much simpler than trying to add an entire clear ejector lever to the DIMM socket body 114 once the socket has been soldered onto the board 116. Furthermore, existing materials may be used to create the DIMM sockets 100 and light pipes 120, thereby eliminating the need to create any new composite materials.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method of manufacturing an ejector lever for a surface mounted electrical connector, the method comprising:

configuring an ejector lever with an aperture therethrough;

pivotally mounting the ejector lever to each of a plurality of electrical connectors, each electrical connector including a connector body configured to receive and electrically connect with an electric module, the ejector lever is pivotally mounted to at least one of first and second ends of each connector body of each electrical connector of the plurality of electrical connectors for releasable retention of a respective electric module; and surface mounting the plurality of electrical connectors to a motherboard; and extending a light pipe through the aperture in the ejector lever for alignment with a fault indicator associated with each electrical connector connected to the motherboard.

2. The method of claim 1, wherein the fault indicator is a light emitting diode.

3. The method of claim 1, further comprising configuring the aperture as a conical or stepped shape aperture to retain one end of the light pipe therewith.

4. The method of claim 1, wherein each connector body is a dual in-line memory module (DIMM) connector body configured to receive a DIMM.

5. The method of claim 1, further comprising:

using lead-free solder to surface mount each electrical connector to the motherboard.

6. The method of claim 1, further comprising forming the aperture before or after pivotally mounting the ejector lever to each of a plurality of electrical connectors.

* * * * *